US006322668B1

(12) United States Patent
Snellman et al.

(10) Patent No.: US 6,322,668 B1
(45) Date of Patent: Nov. 27, 2001

(54) SUCTION BOX IN PAPER MACHINE AND METHOD IN THE SUCTION BOX IN A PAPER MACHINE

(75) Inventors: Jorma Snellman; Antti Poikolainen; Ari Puurtinen; Samppa Salminen, all of Jyväskylä (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 08/998,432

(22) Filed: Dec. 26, 1997

(30) Foreign Application Priority Data

Dec. 31, 1996 (FI) ..... 965277

(51) Int. Cl.[7] ..... D21F 1/48; D21F 11/00; D21F 3/10

(52) U.S. Cl. ..... 162/217; 162/202; 162/363; 162/374; 162/352

(58) Field of Search ..... 162/361, 363, 162/202, 217, 374, 352, 306, 300, 301

(56) References Cited

U.S. PATENT DOCUMENTS

| | | | | |
|---|---|---|---|---|
| 1,638,975 | * | 8/1927 | Antoine | 162/352 |
| 4,234,382 | | 11/1980 | Schiel | 162/263 |
| 5,167,770 | * | 12/1992 | Bubik et al. | 162/301 |
| 5,580,424 | | 12/1996 | Snellman | 162/371 |
| 5,582,687 | * | 12/1996 | Odell et al. | 162/203 |
| 5,635,032 | * | 6/1997 | Bubik et al. | 162/301 |
| 5,681,431 | | 10/1997 | Steiner | 162/360.2 |
| 5,690,792 | * | 11/1997 | Jaakkola et al. | 162/301 |

FOREIGN PATENT DOCUMENTS

| | | | |
|---|---|---|---|
| 4340041 | 4/1994 | (DE) | D21F/3/02 |
| 11313 | 8/1925 | (FI) . | |
| 1657/59 | 7/1968 | (FI) . | |
| 783742 | 6/1979 | (FI) . | |

* cited by examiner

*Primary Examiner*—Stanley S. Silverman
*Assistant Examiner*—Dionne A. Walls
(74) *Attorney, Agent, or Firm*—Steinberg & Raskin, P.C.

(57) ABSTRACT

A suction box in a paper machine including a vacuum chamber, a deck or a number of substantially U-section holders open toward a wire and ribs arranged in the deck or the holders so that they can be loaded against the wire. At least in a running situation, the deck of the suction box is curved or the ribs are arranged to provide a curve run of the wire so that the wire tension of the curved run over the deck or ribs serves to lower a normal force which is produced by the vacuum present in the suction box and which is effective between the wire and the deck or ribs. A method in a suction box in a paper machine, wherein a vacuum is formed in a vacuum chamber of the suction box and, during formation of the vacuum, the deck and/or the ribs is/are pressed against the wire. At least in a running situation, the curve form of the deck of the suction box or the position of the ribs is such that the tension of the wire running over the deck or ribs lowers the normal force which is produced by the vacuum present in the suction box and which is effective between the wire and the deck/ribs.

6 Claims, 14 Drawing Sheets

SUCTION BOX IN PAPER MACHINE AND METHOD IN THE SUCTION BOX IN A PAPER MACHINE

FIELD OF THE INVENTION

The present invention relates to a suction box in a paper machine comprising a vacuum chamber, a deck or a number of substantially U-section holders open toward the wire or equivalent web-supporting substrate, a number of ribs arranged in the deck or the holders and loading means for loading the ribs against the wire or equivalent.

The present invention also relates to a method in a suction box in a paper machine, wherein a vacuum is formed in a vacuum chamber of the suction box and, during formation of the vacuum, a deck and/or loading ribs is/are pressed against the wire or equivalent web-supporting substrate.

BACKGROUND OF THE INVENTION

In connection with suction boxes in paper machines which are used for numerous functions, such as dewatering a web and guiding a wire, particular problems have been the high consumption of power and the rapid wear of the wires running over the suction box The ribs or the common deck on a suction box is/are placed against the wire, i.e., in engagement therewith, in which connection, by the effect of the vacuum in the suction box which is applied to the wire through spaces in the deck or between the ribs, a force is produced between the wire and the ribs, which force is divided into a normal force and a friction force. The friction force between the ribs and the wire increases as a function of the vacuum in the suction box and tile speed of the wire, and as a result of the friction force, intensive wear of the wire arises. This also increases the requirement of power of the suction box.

In suction box constructions in the prior art, as one solution for these problems, instead of suction boxes, suction rolls have been used, in whose connection, however, the high power loss arising from pumping has been still been problematic. Likewise, the cleaning, costs and the high costs of servicing and manufacturing suction rolls have been a drawback of such constructions. Also, it is problematic that when the running speed of the wire becomes high, the consumption of power of the suction roll is increased to a large extent, and also the wear of the wire is increased, for which reasons other solutions are needed for these problems.

OBJECTS AND SUMMARY OF THE INVENTION

An object of the present invention is to provide a solution for eliminating the high consumption of power of a suction box in a paper machine and for preventing the rapid wear of the wires.

It is another object of the present invention to provide a new and improved suction box for a paper machine.

It is still another object of the present invention to provide a new and improved method for arranging and operating a suction box in a paper machine.

In view of achieving these objects and others, the suction box in accordance with the invention includes a deck or ribs arranged so that tension of a wire running over the deck or ribs is effective to lower the normal force which is produced by the vacuum present in the suction box and which is effective between the wire and the deck or ribs. More particularly, the deck of the suction box is curved or the ribs are arranged to enable a curved run of the wire at least in a running situation in order that the wire tension lowers the normal force which is produced by the vacuum present in the suction box and which is effective between the wire and the deck or ribs In the method in accordance with the invention, the deck of the suction box is provided with a curve form or the ribs of the suction box are arranged to enable a curved run of the wire at least in a running situation such that the wire tension lowers the normal force which is produced by the vacuum present in the suction box and which is effective between the wire and the deck or ribs.

In the arrangement in accordance with the invention, the friction between the ribs or the common deck of the suction box and the wire is lower or substantially eliminated, in which connection the consumption of power is lowered and the wear of the wires becomes slower, i.e., the wires last longer. In accordance with the invention, in a normal running situation, the common position formed by the ribs of the suction box or the deck of the suction box is curved (concave), so that the wire tension reduces the normal force which is produced by the vacuum and which is present between the wire and the ribs or deck. The curve form of the deck or ribs is produced either by locking the ribs in a curved (concave) form or by making the deck of the suction box or the position of the ribs curved (concave) in the desired manner in advance, i e, prior to installation in the suction box.

An embodiment of the invention in which the deck of the suction box is fixed and curved (concave) in advance provides a lowering of the friction and thus, the advantages mentioned above. The cost of manufacture of such an embodiment is quite favorable.

With an embodiment of the invention in which the ribs are locked in the desired position and in which a sealing free of contact is achieved, a lower friction force is also achieved, in which case, the requirement of power for the suction box is lowered and the wear of the wire is reduced. With the arrangement in accordance with the invention, the wire can be bent or shaped into a curved form such as a rope curve. According to one preferred additional feature of the invention, it is possible to lock the ribs on the suction box either so that they contact the wire or so that a desired normal force is produced between the rib and the wire, whereby an increased reliability of running is achieved.

Thus, the suction box in a paper machine may comprise means defining a vacuum chamber through which suction is applied, ribs adapted to load a wire and arranged such that spaces are defined between the ribs and communicate with the vacuum chamber, loading means arranged in associated with the ribs to load the ribs toward the wire, and retaining means for retaining the ribs such that while suction is applied through the vacuum chamber and the spaces between the ribs, the ribs cause the wire to curve while running over the ribs such that tension of the wire lowers a normal force produced by the suction. The retaining means may comprise a deck in which the ribs are fixedly mounted. The deck may be stationary and curved.

In the alternative, the retaining means are substantially U-section holders open toward the wire, each holders retaining a respective rib. In this case, locking means are arranged in connection with each rib for locking the same rib in a desired position in the respective holder such that when locking the ribs, the ribs are retracted into the respective holders and locked in a retracted position. The ribs have a bottom surface in opposed relationship to a bottom, interior surface of the respective holder and the loading means, e.g., a loading hose, are arranged between the bottom of each rib and the bottom, interior surface of the respective holder such that the ribs are displaceable by the loading means against the wire. The locking means may comprise a locking rib with slanting faces arranged in a cavity of each holder and a spring member arranged behind the locking rib in the cavity. Sealing means may be arranged at ends of the vacuum chamber for sealing spaces between laterally extending ends of the ribs.

An arrangement for transferring a web from a first wire to a second wire in a paper machine in accordance with the invention includes first guide means for guiding the first wire to support the web over a run thereof, a suction box as described above, second guide means for guiding the second wire to receive the web from the first wire, and a roll arranged in opposed relationship to the suction box such that the first and second wires run between the roll and the suction box. The roll has an open-faced mantle defining a suction chamber and the web is transferred from the first wire to the second during its passage between the suction box and the roll. A last rib in a running direction of the wire may be arranged in an area of a suction sector of the suction chamber or immediately in front of an area of a suction sector of the suction chamber in the running direction of the wire.

In the method for applying suction to a wire in accordance with the invention, a vacuum is formed in a vacuum chamber of a suction box, ribs are pressed against the wire during formation of the vacuum in the vacuum chamber, and the wire is guided in a curve over the ribs while the vacuum is present in the vacuum chamber such that tension in the wire lowers a normal force produced by the vacuum and which is effective between the wire and the ribs. In one embodiment, each rib is arranged in a U-shaped holder and pressed against the wire by applying pressure to force the ribs outward from a respective holder. The wire is guided in a curve over the ribs by releasing the pressure forcing the ribs outward from the holders such that each rib is freely retractable into the respective holder upon the movement of the wire toward the vacuum chamber, and then locking the ribs in a desired position in relation to the wire once the wire attains the desired curve form. The ribs may be locked in a desired position by applying a force from one side of each holder to press the respective rib against the opposed side of the holder The ribs may be pressed against the wire in order to increase the reliability of running of the wire The suction box may be displaced toward or away from the wire to provide desired inlet and outlet angles of the wire in relation to the suction box.

Instead of arranging the ribs in holders, the ribs may be arranged in a stationary deck in a curved form such that spaces are present between the ribs and communicate with the vacuum chamber.

Further advantages and characteristic features of the invention will come out from the following detailed description of the invention.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
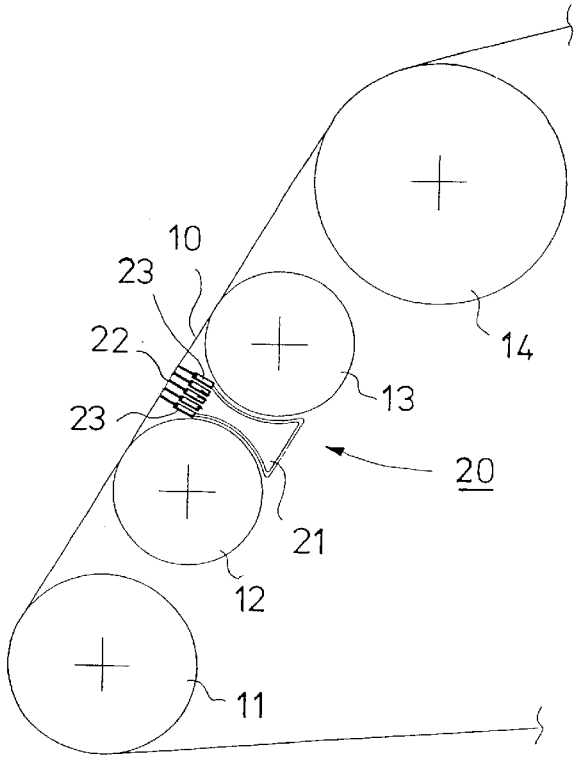
FIG. 1A is a schematic illustration of a suction box in accordance with the invention arranged between two rolls in a situation in which the vacuum for the suction box has not been switched on or when the vacuum has been switched on but the ribs are not yet in a running position.
Figure 1B:
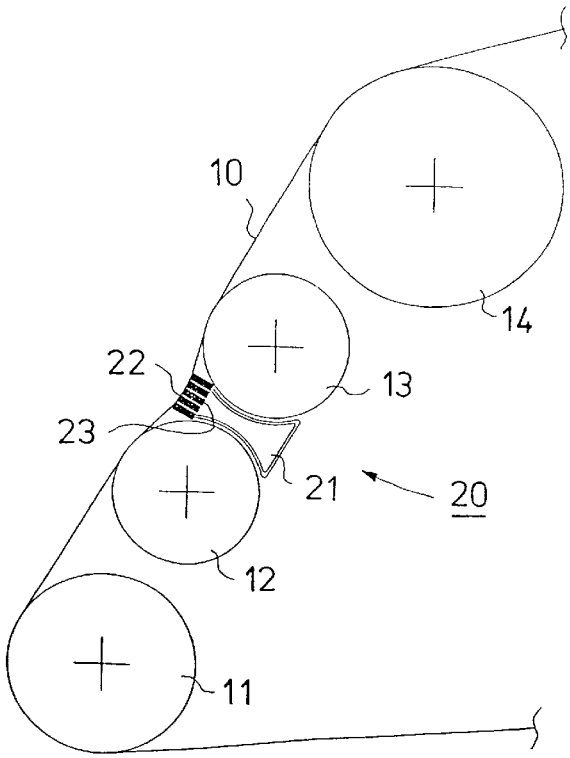
FIG. 1B is a schematic illustration of a suction box in accordance with the invention arranged between two rolls in a situation in which the vacuum has been switched on and when the ribs have been shifted to a running position.

Referring to FIGS. 1–8C wherein like reference numerals refer to the same or similar elements, in the exemplifying embodiment shown in FIGS. 1A and 1B, a suction box in accordance with the invention designated generally as 20 is arranged between two rolls 12, 13, and the suction box 20 is provided with movable ribs 22 arranged in holders 24 A wire 10 runs in a loop over rolls 12,13 and besides the rolls 12 and 13, the wire 10 also runs over rolls 11 and 14 Wire 10 may be supporting a web. The suction box 20 includes means defining a vacuum chamber 21 in which negative pressure (vacuum) may be effective The sides of the suction box 20 conform to the shape of the adjoining rolls 12,13

In the situation shown in FIG. 1A, there is no vacuum in the vacuum chamber 21 of the suction box 20, in which case, the wire 10 runs straight between rolls 12, 13 and the ribs 22 are loaded against the wire 10 by a loading pressure produced by loading means which serve to extend the ribs 22 outward away from the suction box 20. In the situation shown in FIG. 1B, a vacuum is applied to the suction chamber 21 in the suction box 20, in which connection, the vacuum pulls the wire 10 into a curve form at the suction box 20 and the ribs 22 are retracted into their holders 24 when the loading pressure of the ribs 22 is eliminated. When the vacuum level in the suction chamber 21 and the distance of the wire 10 from the suction box 20 are at a desired level and distance, for example do not change any more, the ribs 22 of the suction box 20 are locked at the position in which they are retracted by means of a locking mechanism, which will be described in more detail later, most appropriately in a position in which a small tap remains between the wire 10 and the ribs 22. In this manner, a sealing free of contact between the wire 10 and the ribs 22 is obtained thereby avoiding wear of the wire.

In the exemplifying embodiment shown in FIGS. 1A and 1B, the suction box 20 is placed in a fixed position because there are the rolls 12,13 at a very short distance at both sides of the suction box 20. In such a case, the inlet angle and the outlet angle of the wire 10 in relation to the suction box 20 can be made sufficiently large.

Thus, when the situations in FIGS. 1A and 1B are compared to one another, it is noticed that the vacuum pulls the wire into a curve form, whose shape corresponds to the shape of a rope curve, i.e., a cosine hyperbola. In such a case, a situation is reached in which the load per unit of length of the wire is even, in which case the wire 10 has a tension, and the vertical component of force carries the load and reduces the normal force, in which situation, the ribs 22 can be separated from the wire 10, without substantial reduction of the vacuum, and locked in their positions, cf FIG. 6. The curve form of the wire depends on the magnitude of the vacuum that is applied and on the wire tension. Thus, the ribs 22 on the suction box 20 are locked, e.g. when the vacuum level in the suction box 20 and the distance of the wire 10 from the suction box 20 do not change any more. At the same time, the locking mechanism detaches the ribs 22 slightly apart from the wire without substantially lowering the vacuum level, in which connection the consumption of power by the suction box and the wear of the wire are reduced.

Figure 2A:
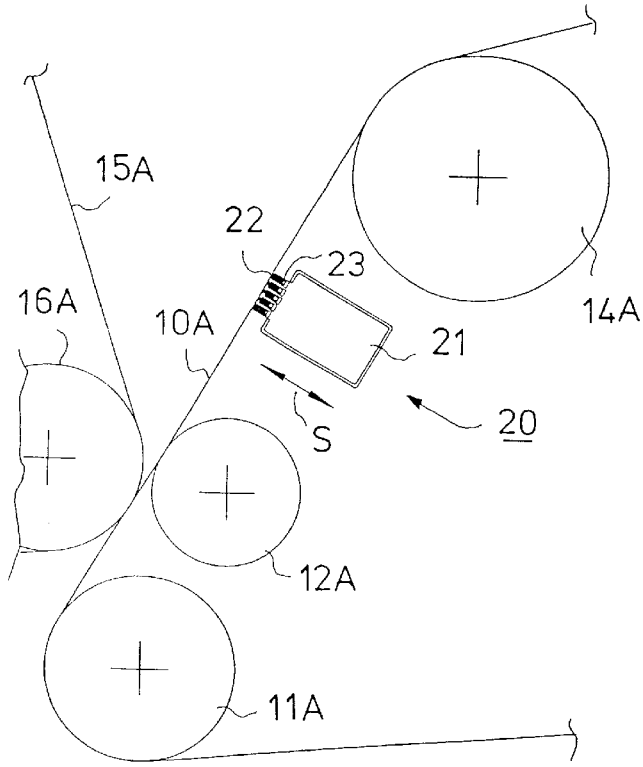
FIG. 2A is a schematic illustration of a suction box in accordance with the invention arranged on a straight run of a wire in a situation in which the vacuum has not been switched on or when the vacuum has been switched on but the suction box is not yet in a running position.
Figure 2B:
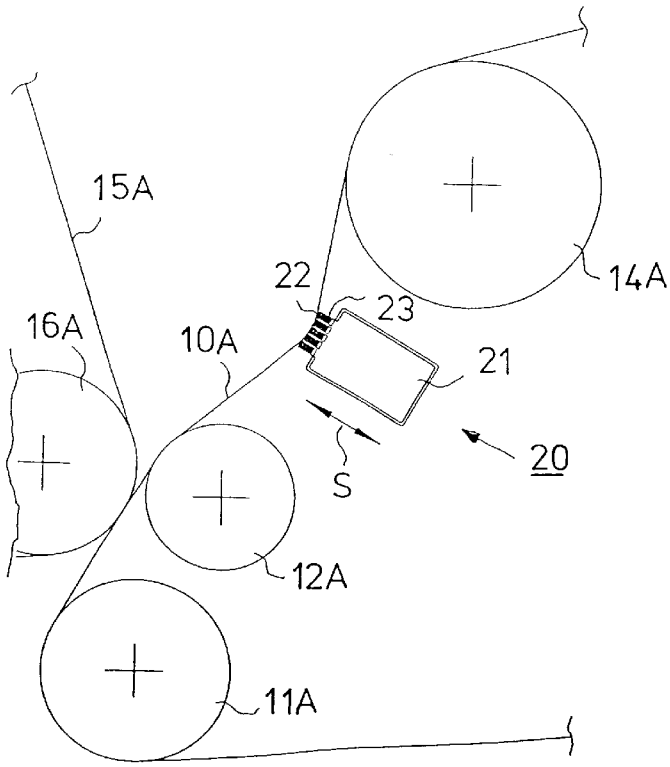
FIG. 2B is a schematic illustration of a suction box in accordance with the invention arranged on a straight run of the wire in a situation in which the vacuum has been switched on and when the suction box has been shifted to a running position.

FIGS. 2A and 2B show an embodiment in which the suction box 20 is placed on a straight run of the wire 10A between rolls 12A and 14A whereby the wire 10A runs in a loop and rolls 12A and 14A are arranged in the loop of the wire 10A. FIGS. 2A and 2B also show a roll 11A arranged in the loop of the wire 10A after the roll 12A, a press felt 15A arranged to contact a web being carried on wire 10A and a pickup roll 16A over which the press felt 15A runs In this exemplifying embodiment, the suction box 20 is displaceable by displacement means connected thereto, which is indicated by arrow S. In the situation shown in FIG. 2A, there is no vacuum in the suction chamber 21 of the suction box 20, or the vacuum has been switched on, but the suction box is not yet in the running position, and FIG. 2B shows a situation in which there is a vacuum in the suction chamber 21, and the suction box has been shifted into the running position. When the suction box 20 is displaced in the direction of the arrow S, the inlet and outlet angles of the wire 10A into and out of the area of the ribs 22 on the suction box can be brought to the desired level so that the desired curve form is obtained. The operation of the ribs 22 on the suction box 20 is similar to that described above and also to what will be described later in relation to FIGS. 4A–4D.

Figure 3A:
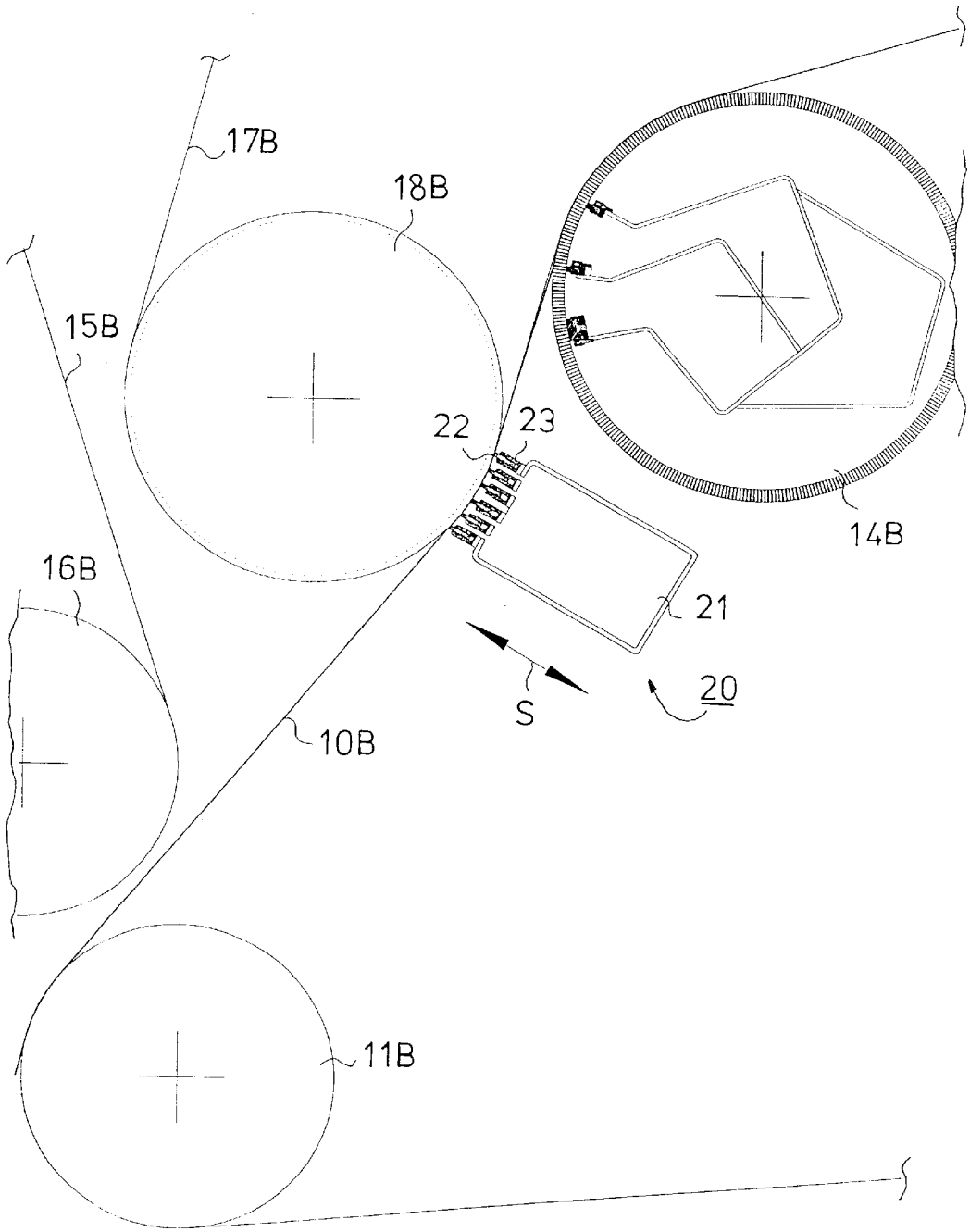
FIG. 3A is a schematic illustration of a suction box in accordance with the invention arranged opposite a roll in a situation in which two wires run over the roll and when the vacuum has not been switched on or when the vacuum has been switched on but the suction box is not yet in a running position.
Figure 3B:
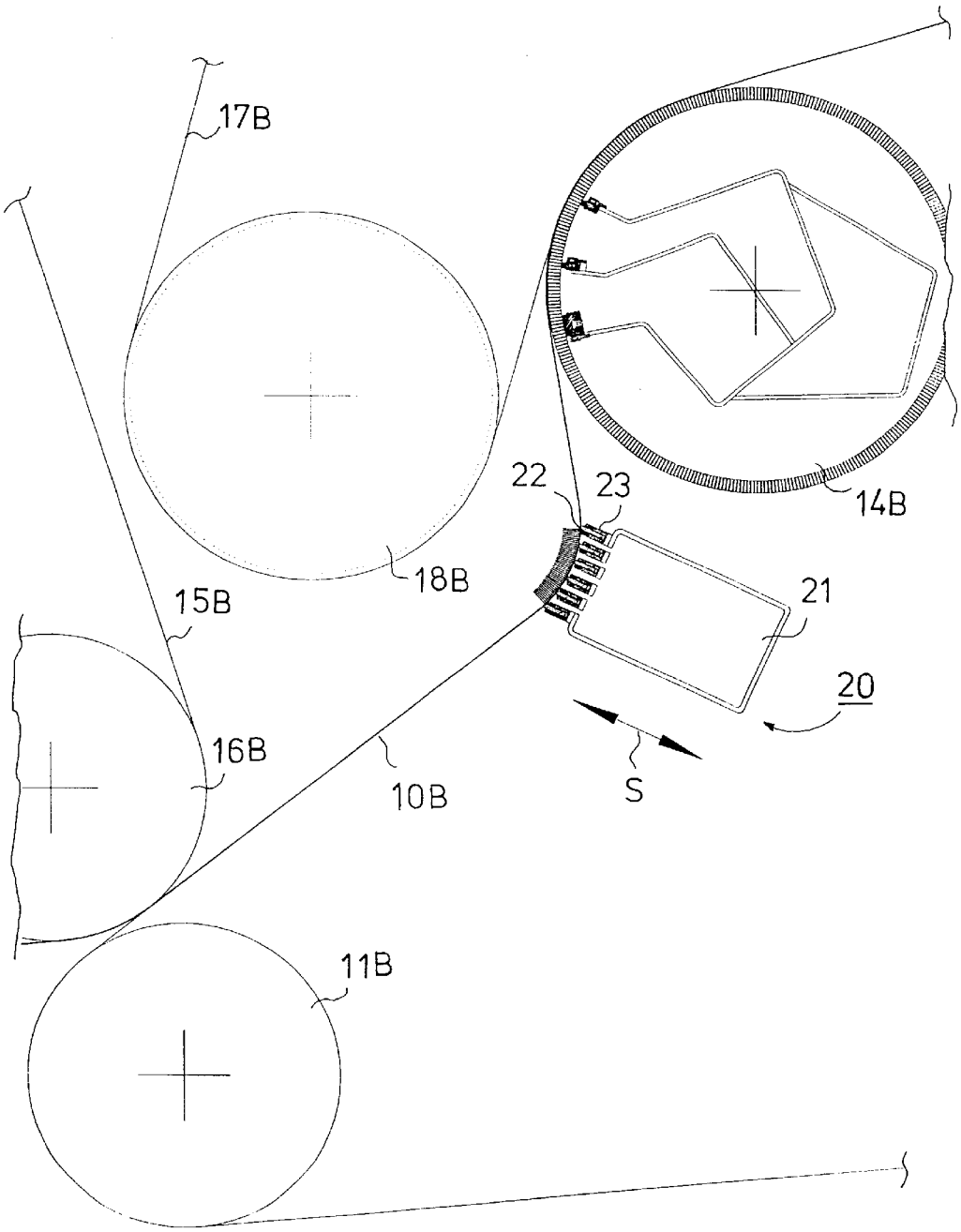
FIG. 3B is a schematic illustration of a suction box in accordance with the invention arranged opposite a roll in a situation in which two wires run over the roll and when the vacuum has been switched on and when the suction box has been shifted into a running position.
Figure 3C:
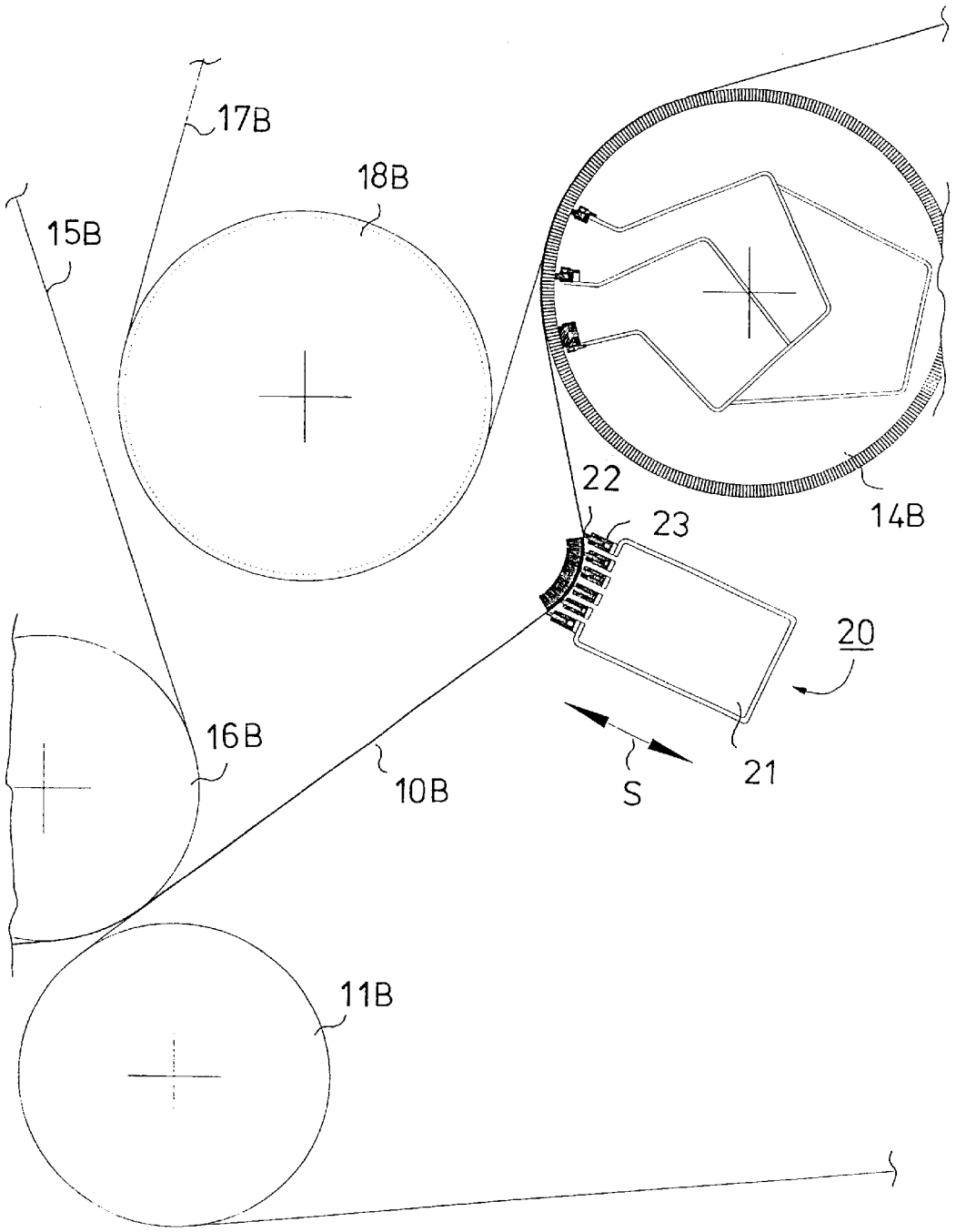
FIG. 3C is a schematic illustration of a suction box in accordance with the invention arranged opposite a roll in a situation in which two wires run over the roll and when the vacuum has been switched on to a vacuum level higher than that in the preceding FIG. 3B and when the suction box has been shifted into a running position.

In the exemplifying embodiment shown in FIGS. 3A and 3B, the suction box 20 is arranged opposite a roll 18B around which two wires 10B, 17B run at the location of the suction box 20. The roll 18B is open, i.e., has an open mantle, so that it is possible to produce a suction effect through it, for example a grooved roll or some other hollow-faced roll. The pickup felt of the press section is denoted by reference numeral 15B, and the related pick-up roll around which the pickup felt 15B runs is denoted by reference numeral 16B. The wire 10B runs over the rolls 11B and the suction roll 14B. Of the rolls shown in FIGS. 3A–3C, the wire 17B runs over the roll 18B. In the exemplifying embodiment shown in FIGS. 3A–3C, the suction box 20 is displaceable by displacement means connected thereto, which is indicated by arrow S. In the situation as shown in FIG. 3A, there is no vacuum effective in the suction chamber 21 of the suction box 20, or a vacuum has been switched on, but the suction box is not yet in the running position In the exemplifying embodiment shown in FIG. 3B, a certain vacuum is effective in the suction chamber, and a certain wire tension is applied accordingly. In FIG. 3C, the vacuum is higher than the vacuum in FIG. 3B, and the wire tension is the same as in FIG. 3B, in which case the wire 10B is bent to a greater extent into curve form and the suction box 20 has been shifted further apart from the roll 18B. The curve form produced by means of the suction box 20 depends on the wire 10B tension and on the vacuum employed in the suction box 20.

In the following, with reference to FIGS. 4A–4D, the stages taking place in the suction box in accordance with the invention will be described in detail. The effect of the suction chamber 21 of the suction box 20 is transferred to the wire through spaces or gaps 28 between the ribs 22. The ribs 22 are attached to their holders 24, preferably arranged in a U-section space formed in the holder 24. At the bottom of the U-section space there is a loading space 23 in which there may be, for example, a loading hose (not shown in the figure) or other suitable loading means for loading the rib toward the wire. The loading hose used for locking the ribs 22 in a certain position is denoted by reference numeral 25, the spring members of the rib 22 which also are used to lock the ribs 22 are denoted by reference numeral 26, and the seals arranged in recesses in the holder 24 for sealing the rib 22 in the holder 24 are denoted by reference numeral 27. The locking ribs or members of the ribs 22 are denoted by reference numeral 33.

Figure 4A:
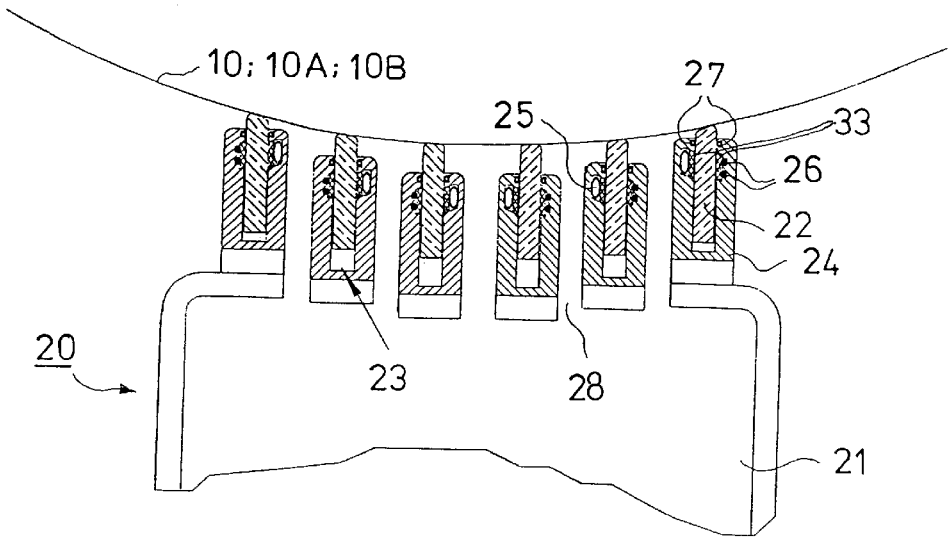
FIG. 4A is a schematic illustration of the forces effective in connection with a suction box in accordance with the invention in a situation in which there is no vacuum in the suction box and the ribs have not been locked.
Figure 4B:
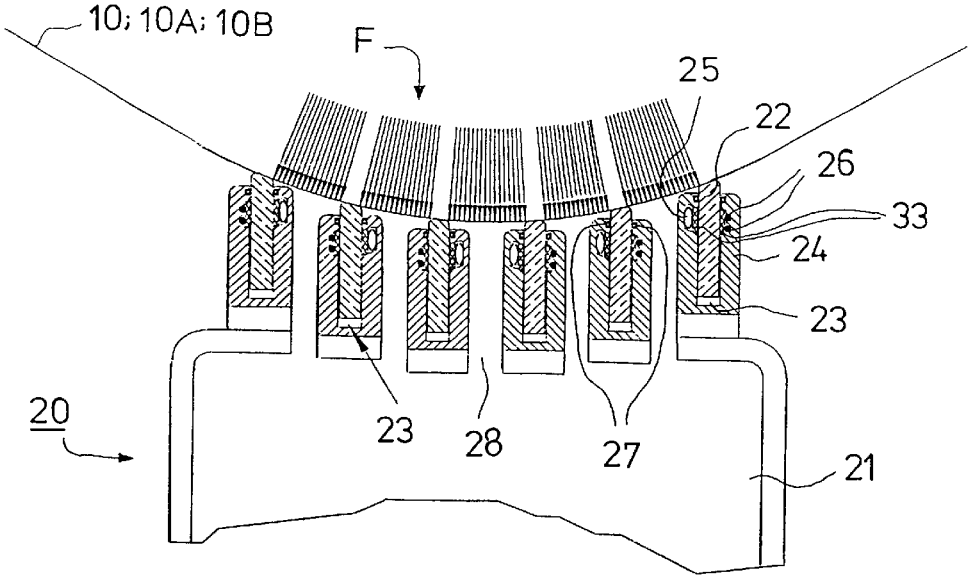
FIG. 4B is a schematic illustration of the forces effective in connection with a suction box in accordance with the invention in a situation in which a vacuum is effective in the suction box and the ribs have not been locked.

In situations illustrated in FIGS. 4A and 4B, the ribs 22 have not been locked in their position in their holders 24. More particularly, in the situation shown in FIG. 4A, there is no vacuum in the suction chamber 21, and in the loading space 23 below the ribs 22 there is a loading pressure, in which case the ribs 22 are pressed against the wire 10, 10A, 10B. In FIG. 4B a vacuum is effective in the suction box 21, but a normal atmospheric pressure is effective in the loading space 23 of the ribs 22, in which case the wire 10, 10A, 10B is positioned in a curve form similar to a rope curve toward the suction box 20, and the difference in pressure between the lower face and the upper face of the rib keeps the ribs 22 in contact with the wire. In this manner, the force zone F, which represents the zone of action of the suction provided by the suction chamber 21, is divided into sectors and in which connection no force is effective at the ribs 22 because the loading space of the ribs is at a normal atmospheric pressure and the ribs 22 engage with the wire 10, 10A, 10B.

Figure 4C:
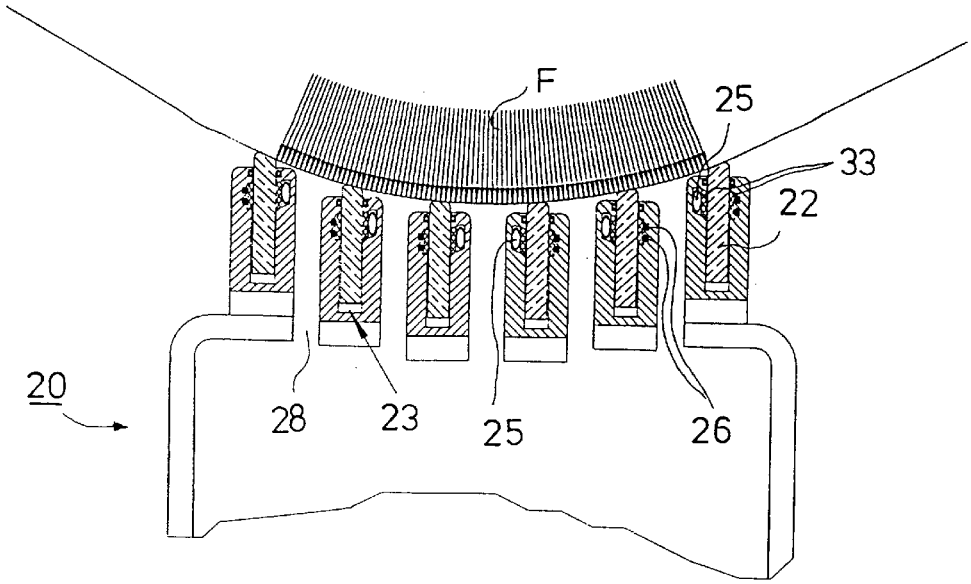
FIG. 4C is a schematic illustration of the forces effective in connection with a suction box in accordance with the invention in a situation in which the vacuum of the suction box is effective under the ribs and the ribs have not been locked.
Figure 4D:
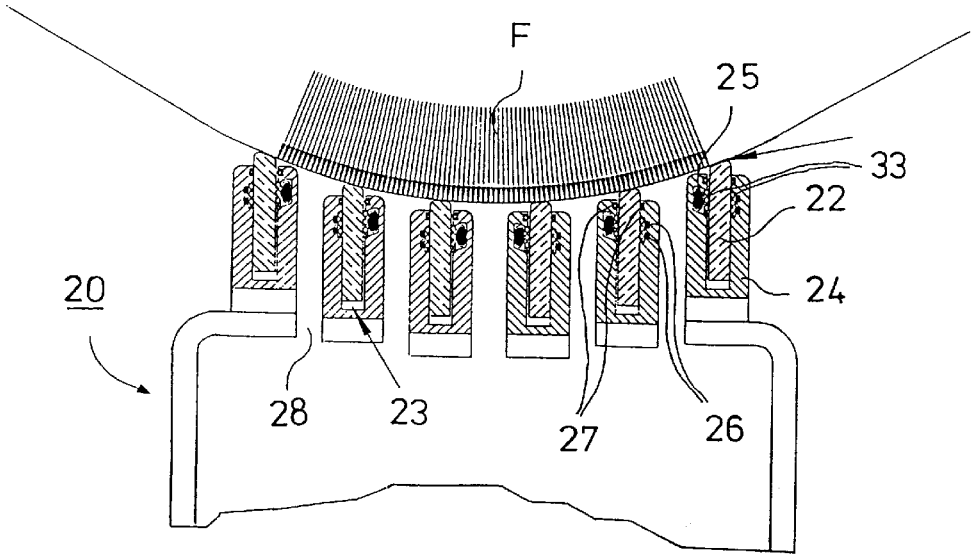
FIG. 4D is a schematic illustration of the forces effective in connection with a suction box in accordance with the invention in a situation in which the vacuum of the suction box is effective under the ribs and the ribs have been locked.

As shown in FIG. 4C, the vacuum of the suction box 20, or another separate vacuum, is effective in the loading spaces 23 of the ribs 22, in which case, the ribs 22 do not press the wire, i.e., are removed from engagement therewith, and the force zone F is thus continuous since it is not impeded by the engagement of the ribs 22 with the wire 10, 10A, 10B. In FIG. 4D, the vacuum of the suction chamber 21 of the suction box 20 is effective in the loading space 23 below the ribs 22, and the ribs 22 have been locked in a fixed position relative to the holder 24 by pressurizing the locking-loading hose 25, in which situation the ribs 22 remain in their place in their holders 24. During locking, the ribs 22 are pressed downward away from the wire 10, 10A, 10B since they are guided by locking ribs 33 which have slanted or angled faces, whereby a sealing free of contact between the wire 10, 10A, 10B and the ribs 22 is obtained. The cavity in the holder 24 in which the locking ribs 33 are arranged is correspondingly slanted to enable a downward angled force to be applied as the locking ribs 33 are moved toward the rib 22 by the expansion of the locking-loading hose 25.

Figure 5A:
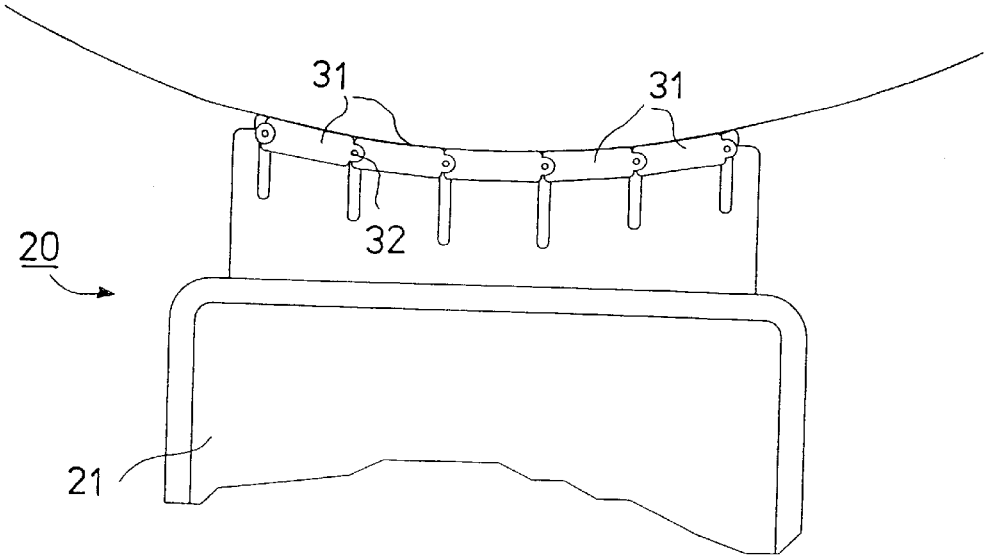
FIG. 5A is a schematic illustration of the sealing of the ends of the suction box in accordance with the invention in a situation in which there is no vacuum in the suction box.
Figure 5B:
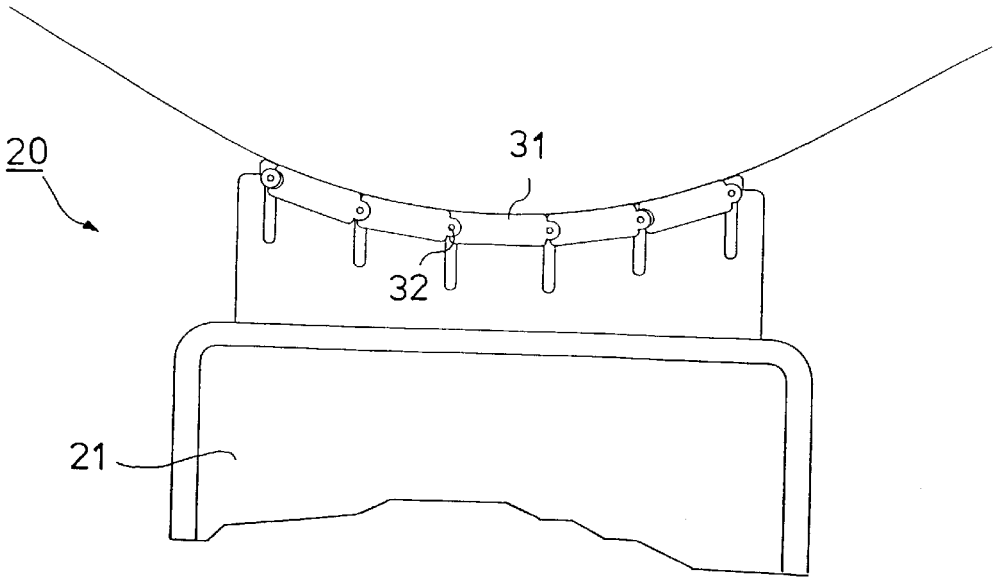
FIG. 5B is a schematic illustration of the sealing of the ends of the suction box in accordance with the invention in a situation in which there is a vacuum in the suction box.

As shown in FIGS. 5A and SB, an end sealing is arranged when the suction box 20 is placed, for example, in connection with a roll, by means of sealing members 31 which are interconnected by means of articulated joints 32 so that the shape of the end sealing 31 conforms to the curved form of the wire 10 about the ribs 22.

Figure 6:
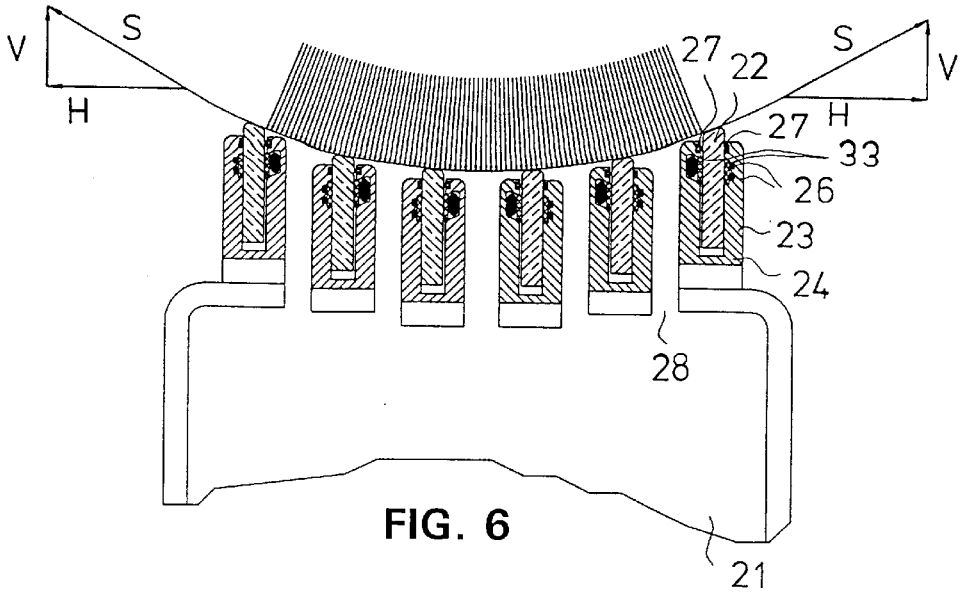
FIG. 6 is a schematic illustration of the vacuum load applied to the wire and of the wire tension in a case of an exemplifying embodiment of the arrangement in accordance with the invention.

FIG. 6 illustrates the vacuum load applied to the wire as well as the wire tension vector S and its vertical component V and horizontal component H. As shown in FIG. 6, the load per unit of length of the wire is even, in which connection, the wire 10 has a tension and the vertical force component V carries the load and lowers the normal force, in which case the ribs 22 can be separated from the wire 10 with no substantial lowering of the vacuum. In accordance with the invention, the ribs can be locked in the desired position, for example in a contact-free position or, for example, in a position in which the desired normal force is effective, whereby an increased reliability of running is achieved.

Figure 7A:
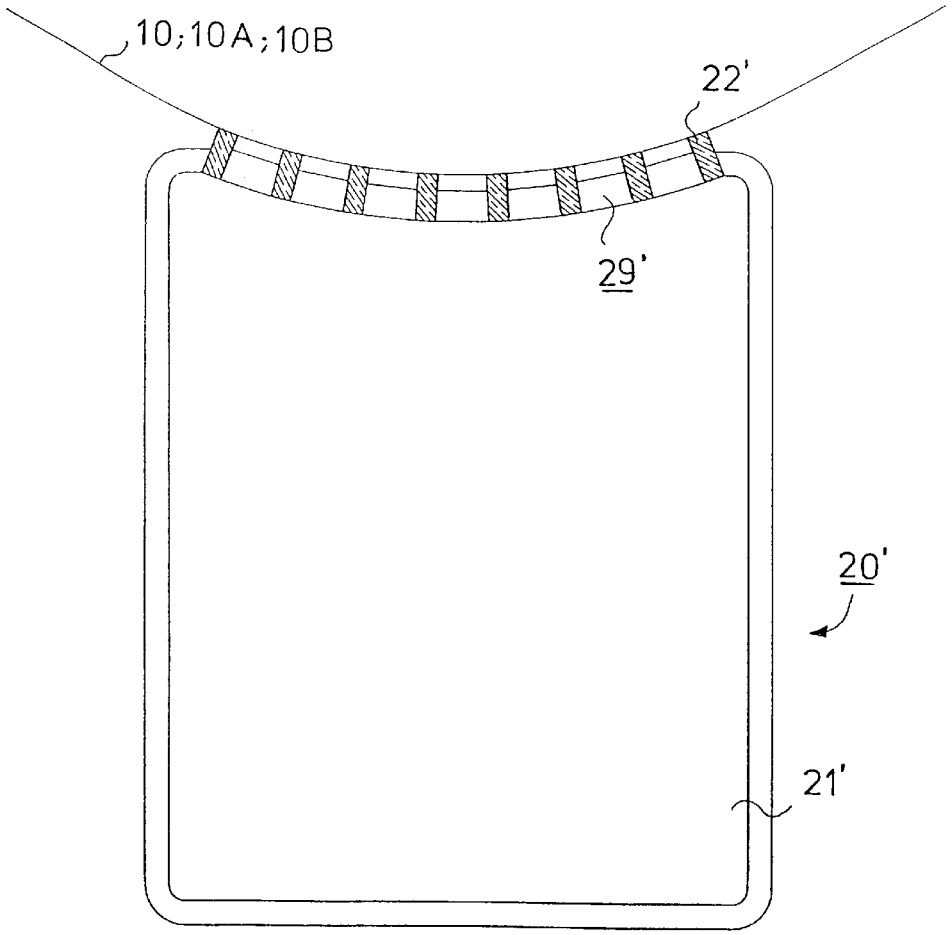
FIG. 7A is a schematic sectional view of a suction box in accordance with a second exemplifying embodiment of the invention.
Figure 7B:
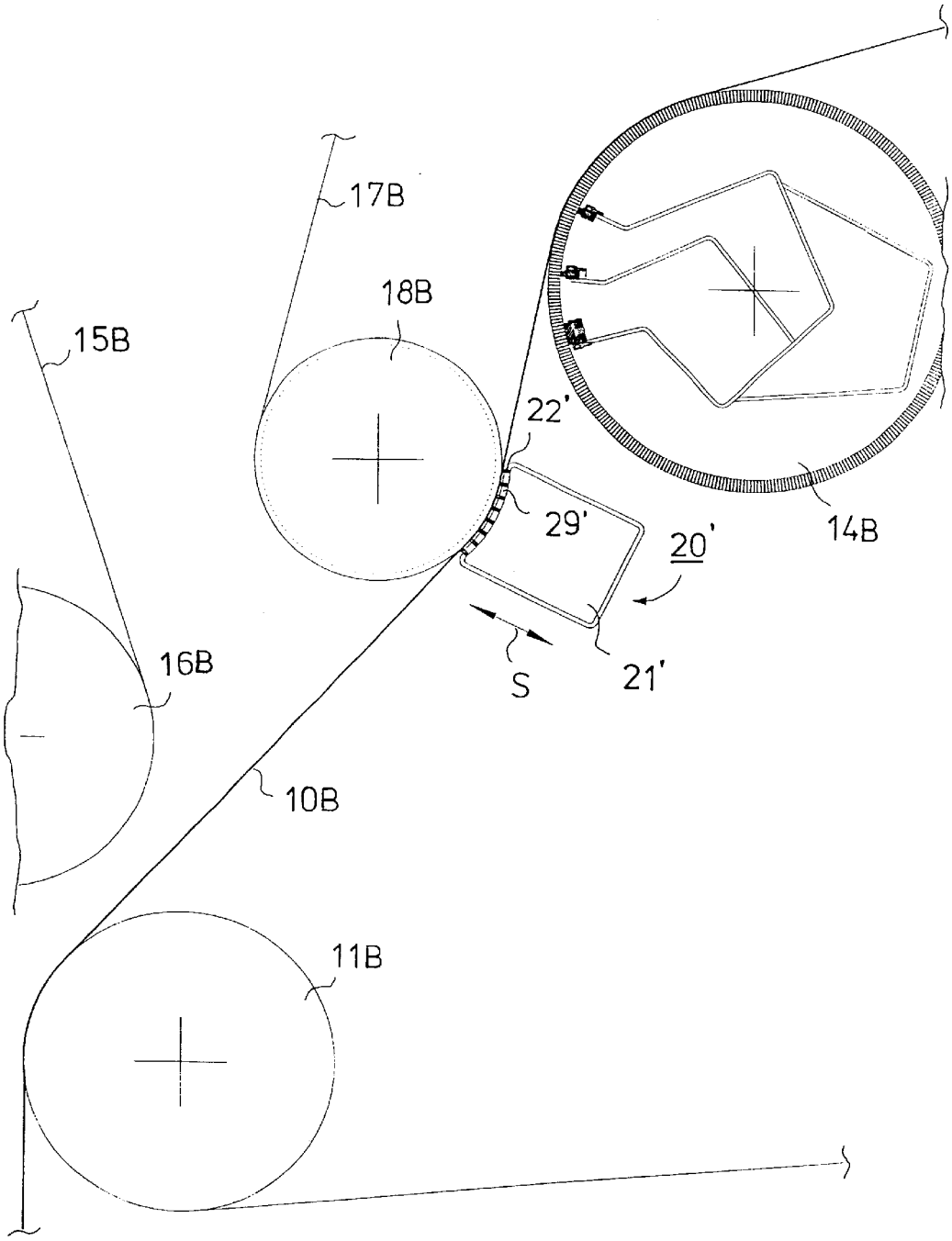
FIG. 7B is an illustration of the suction box shown in FIG. 7A when the vacuum has not been switched on or when the vacuum has been switched on but the suction box is not yet in a running position.
Figure 7C:
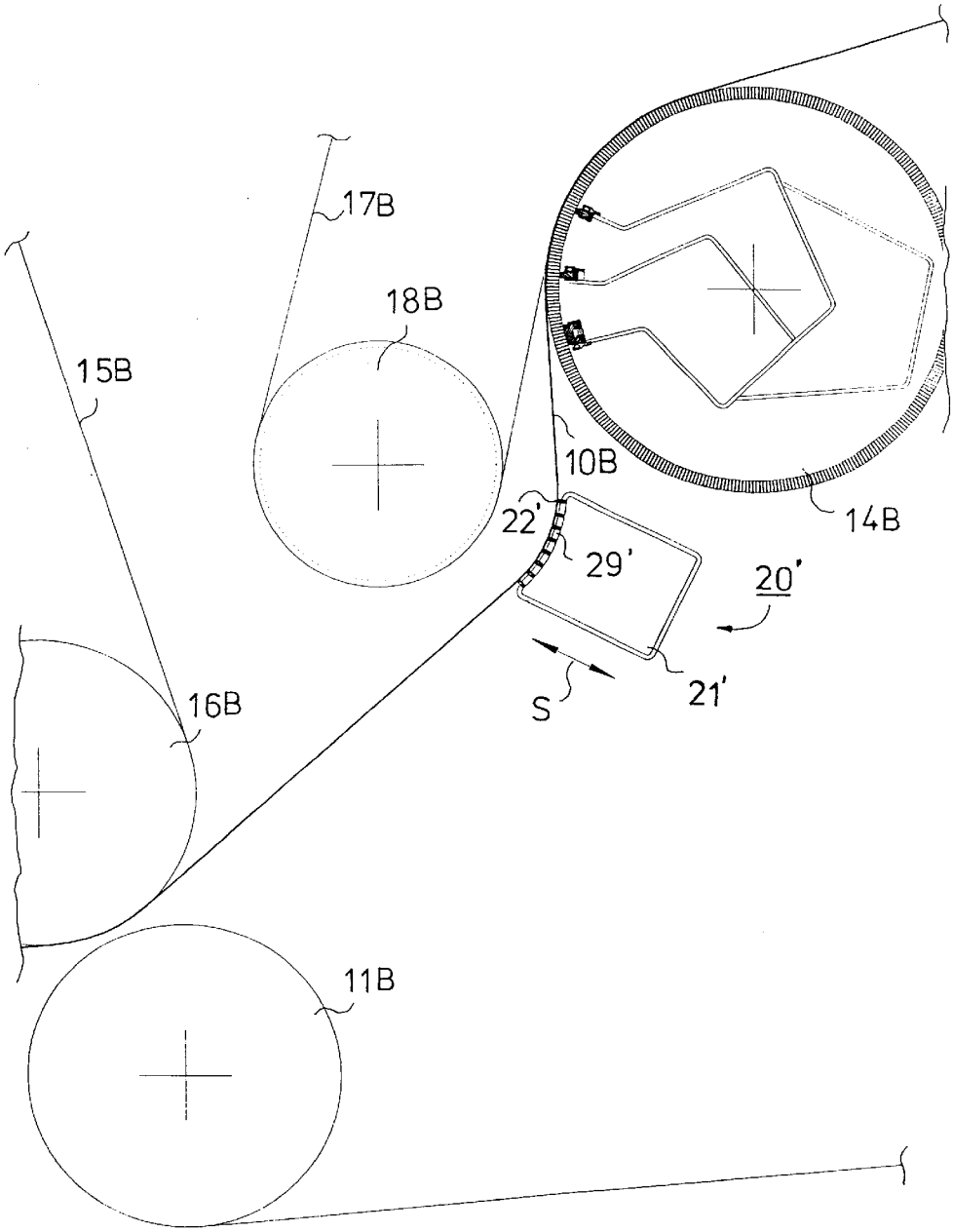
FIG. 7C is an illustration of the suction box shown in FIG. 7A with the vacuum switched on and with the suction box shifted to a running position.

In the exemplifying embodiment of the suction box in accordance with the invention shown in FIG. 7A, suction box 20' includes a deck 29' which is fixed in position and manufactured ready-made in the desired curved (concave) form, in which case ribs 22' of the deck 29' are in a similar curved form. Spaces remain between the ribs 22' and are in communication with the suction chamber 21'. FIGS. 7B and 7C show a suction box 20' similar to that shown in FIG. 7A placed opposite to a roll in cases corresponding to FIGS. 3A and 3B. In FIGS. 7B and 7C, the same reference numerals are used for corresponding parts, compared with FIGS. 3A and 3B. In the exemplifying embodiment shown in FIGS. 7B and 7C, the suction box 20' is placed opposite to the roll 18B around which two wires 10B, 1 7B adjacent the suction box 20'. The roll 18B is open so that a suction effect can be produced through it, for example a grooved roll or some other hollow-faced roll. The pick-up felt of the press section is denoted by reference numeral 15B, and the related pick-up roll over which the pick-up felt 15B runs is denoted by reference numeral 16B. The wire 103B runs over the roll 11B and over the suction roll 14B. Of the rolls shown in FIGS. 7B and 7C, the wire 177B runs over the roll 18B. In the exemplifying embodiment shown in FIGS. 7B and 7C, the suction box 20' is displaceable by appropriate displacement means, which is indicated by the arrow S. In the situation shown in FIG. 7B, no vacuum is effective in the suction chamber 21' of the suction box 20', or a vacuum has been switched on, but the suction box is not yet in the running position, e.g., the paper machine is not operating to form a useable web. In the exemplifying embodiment shown in FIG. 7C, a certain vacuum is effective in the suction chamber and the wire has a certain tension. The curve form produced by means of the suction box 20' depends on the tension in wire 10B and on the curve form of the deck 29' of the suction box 20'.

Figure 8A:
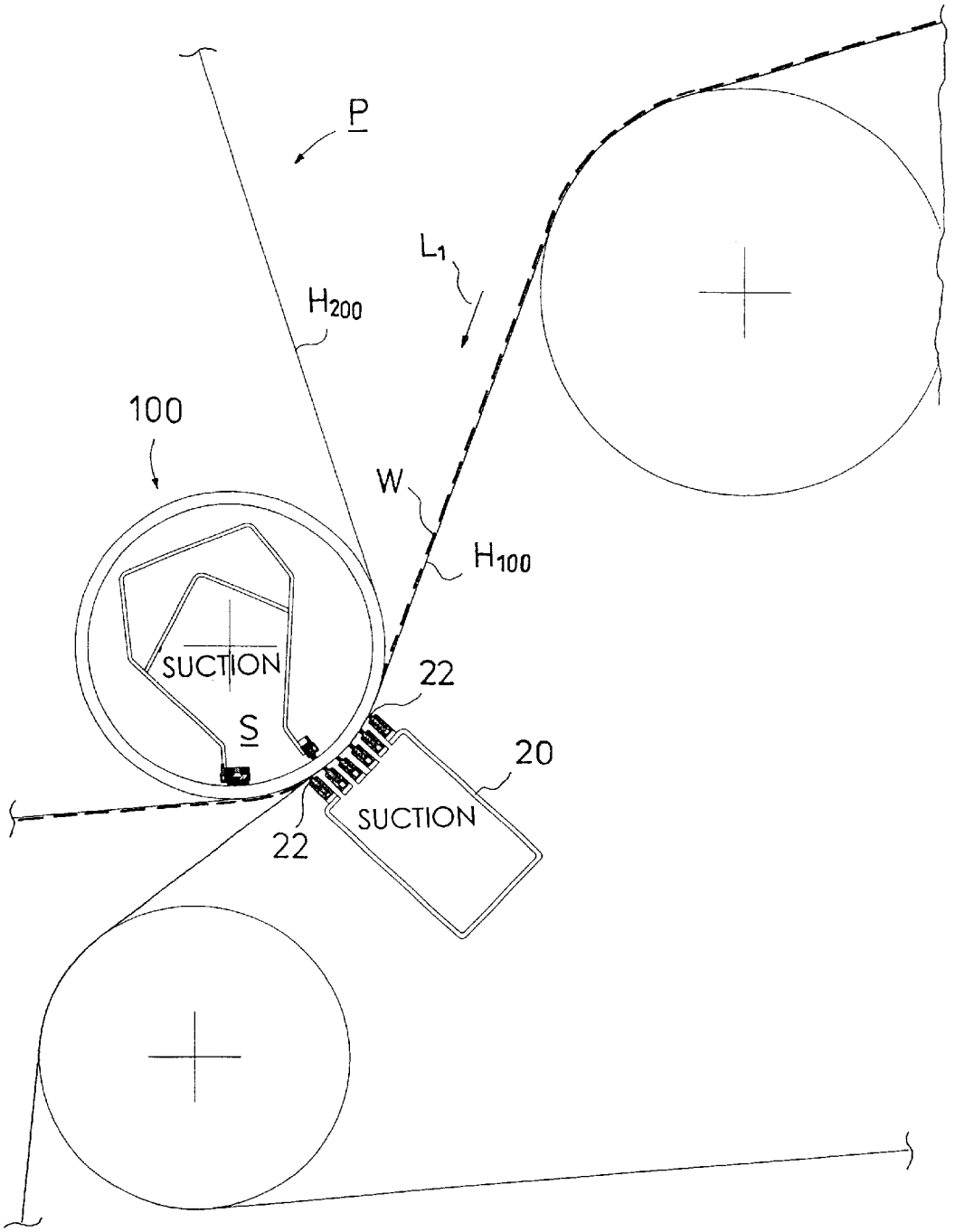
FIG. 8A illustrates a preferred location of the suction box in accordance with the invention opposite to an open roll, preferably a suction roll provided with an inside suction box.

FIG. 8A illustrates a favorable position of a suction box 20 in accordance with the invention in a paper machine in connection with a pick-up roll 100 of a press section. The felt run of the press section P is denoted by reference numeral $H_{200}$ and the wire run of the wire part (or forming section) is denoted by reference numeral $H_{100}$. Pick-up roll 100 is arranged inside the loop of the felt $H_{200}$. The pick-up roll 100 is a perforated roll which comprises an inside suction box 101. By means of the suction in suction box 101 of pick-up roll 100, the web W is picked up from the wire H110 and transferred to the press section P.

As shown in FIG. 8A, the web W is passed along with the wire $H_{200}$ and transferred by means of the suction of the pick-up roll 100 to the press section. The location of the suction box 20 shown in FIG. 8A is advantageous because the run of the web W can be supported by means of the pick-up roll. The following advantages are obtained:

- By means of the open roll 100, the lateral areas can be supported and sealed and, when a situation of disturbance occurs (the suction is lost), the wire cannot become slack abruptly. Even when the suction is lost, the operation can be continued normally.
- When the suction box is placed in connection with the pick-up roll 100, no extra roll is needed.
- The location of the suction box 20 permits separation of the web W from the wire $H_{100}$ directly after the suction box 20, in which case rewetting of the web W is minimized.

By means of an arrangement of equipment in accordance with the invention, a maximal level of dry solids content is achieved without wearing the wire $H_{100}$.

Figure 8B:
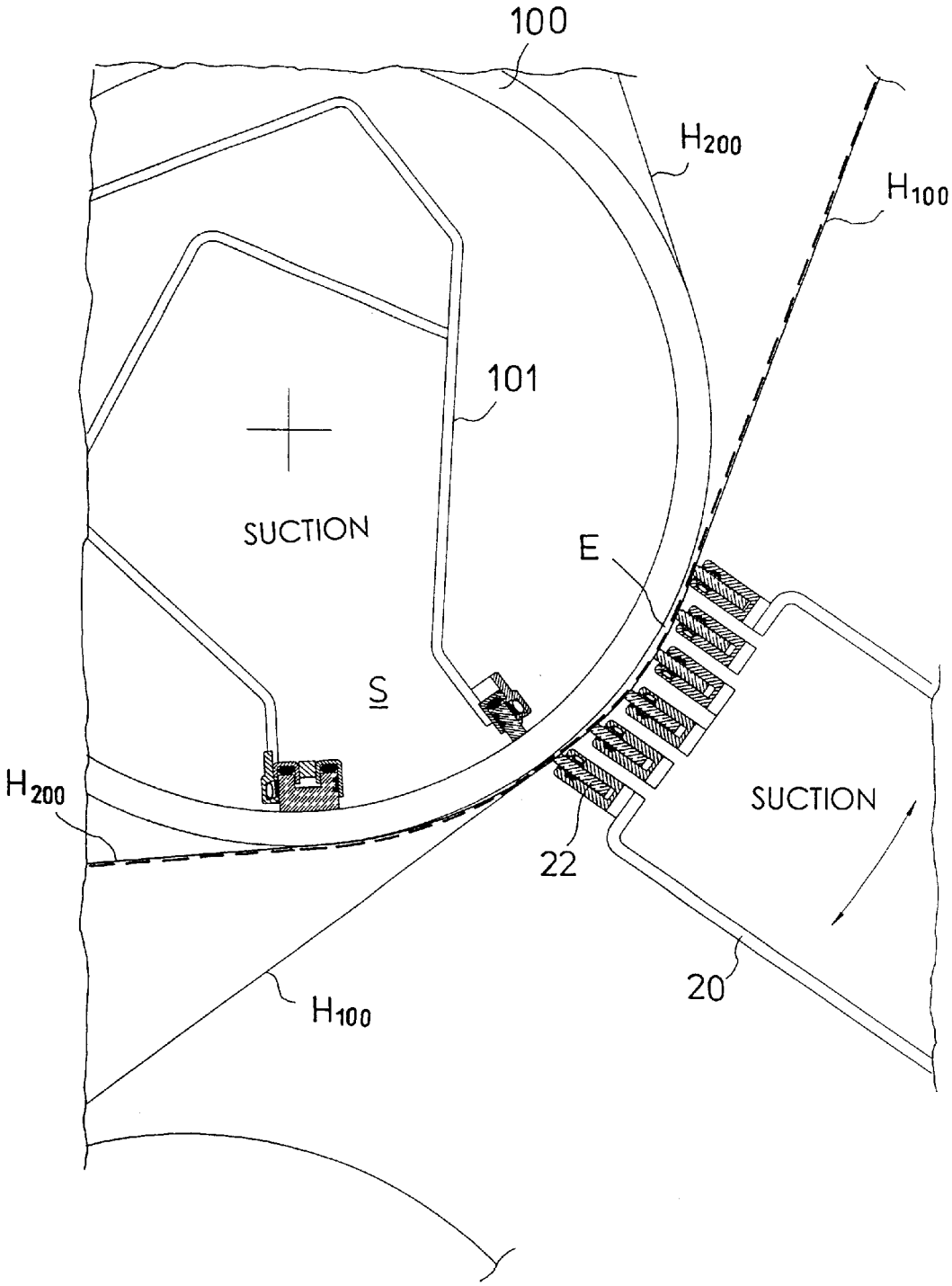
FIG. 8B illustrates the operation of a suction box in accordance with the invention arranged in the position shown in FIG. 8A when the ribs are adjusted so that a desired gap is produced between the ribs and the face of a pick-up roll placed opposite to the ribs, in which connection rewetting of a web is prevented.

FIG. 8B illustrates a preferred mode of operation of the suction box 20 in accordance with the invention in the position shown in FIG. 8A. The ribs 22 are positioned on the suction box 20 so that an air gap E remains between the ribs 22 and the pick-up roll 100. In such a case, the felt $H_{100}$ is placed apart from the web W. By means of the construction, unnecessary wetting of the web W is prevented. In this position, when the suction box 20 has been arranged immediately before a suction zone or sector S of the pick-up roll 100, the web W is passed directly after the last rib on the suction box 20, being picked up by the pick-up roll 100, to the press section P, and wetting of the web by contact with the wire $H_{100}$ after the suction box is substantially prevented. In such a case, the wire Hloo is separated directly after the last rib of the suction box 20 out of connection with the web W passing to the press section P.

When the web is passed to the press section, the suction in the pick-up roll and the suction in the suction box can be maintained at the same time. This is not detrimental to the running of the web W. It is a further essential feature in view of the operability of the transfer arrangement utilizing a suction box in accordance with the invention that the pick-up roll 100 is a perforated roll and that its mantle face thus forms an open roll. The suction box 20 is arranged in such a way in relation to the pick-up roll 100 that the last rib on the suction box, as viewed in the running direction of the web W, is placed substantially exactly at the starting point of the suction zone S of the pick-up roll, or it may be placed slightly overlapping in relation to the starting point, i.e., slightly in the area of the suction sector S of the pick-up roll 100. The position of the suction box 20 shown in FIGS. 8A and 8B is also favorable in the respect that, even if the pick-up roll 100 has no suction and the suction box 20 has no suction, this is not harmful for the running of the web W.

Figure 8C:
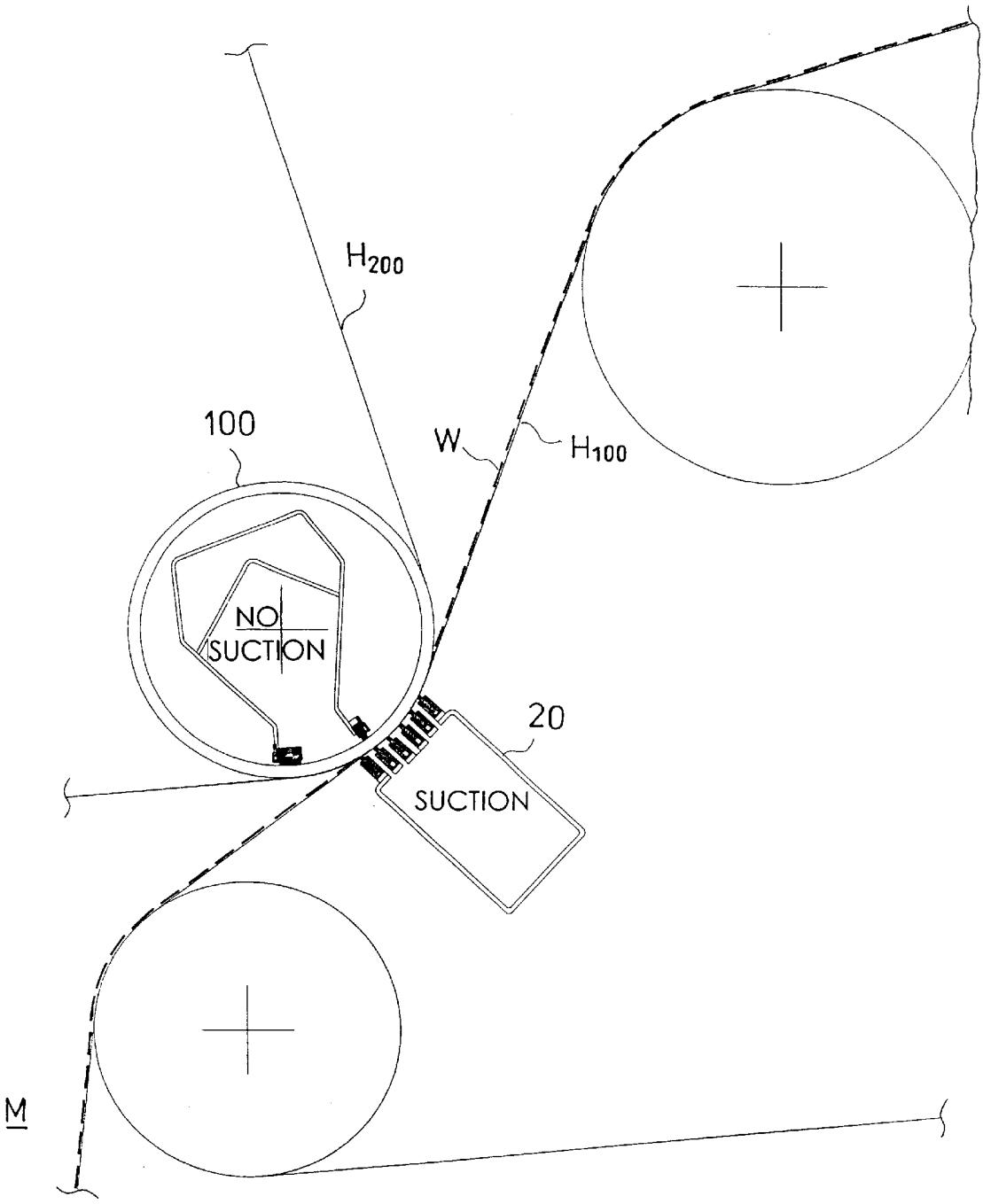
FIG. 8C shows an embodiment in which the web is passed into a couch pit and in which embodiment the pick-up roll has no suction, but there is suction in the suction box.

FIG. 8C shows an embodiment of the invention in which the paper or board web W is passed into a couch pit M. In such a case, the pick-up roll 100 has no suction, whereas, correspondingly, the suction is effective in the suction box 20.

Besides in connection with the high-pressure suction box applications in the wire part, described above, the invention is also suitable for use, for example, in connection with the felt suction devices employed in the press section or transferring a web from a press section to a dryer section. The suction box in accordance with the invention can also be used wherever conventional suction boxes are situated.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A method for applying suction to a wire passing over a suction box, comprising the steps of:

forming a vacuum in a vacuum chamber of a the suction box, pressing ribs arranged on the suction box against the wire while the vacuum is present in the vacuum chamber, arranging the ribs in a curved arrangement to guide the wire in a curve over the ribs while the vacuum is present in the vacuum chamber to increase the tension of the wire and to reduce a normal force produced by the vacuum and which is effective between the wire and the ribs, and arranging each of the ribs in a respective holder for retaining each rib and enabling the adjustment and locking of each rib in a desired curved position, each of the ribs being pressed against the wire by applying pressure to force each of the ribs outward from its respective holder.

2. The method of claim 1, wherein the step of arranging the ribs in a curved arrangement comprises the steps of releasing the pressure forcing the ribs outward from the holders such that each rib is freely retractable into the respective holder upon the movement of the wire toward the vacuum chamber, and then locking the ribs in a desired position in relation to the wire once the wire attains the desired curve form.

3. The method of claim 2, wherein the step of locking the ribs in a desired position comprises the step of:

applying a force from one side of each holder to press the respective rib against the opposed side of the holder.

4. The method of claim 1, wherein the ribs are pressed against the wire in order to increase the reliability of running of the wire.

5. The method of claim 1, further comprising the step of:

displacing the suction box toward or away from the wire to provide desired inlet and outlet angles of the wire in relation to the suction box.

6. A method for applying suction to a wire passing over a suction box, comprising the steps of:

forming a vacuum in a vacuum chamber of the suction box, pressing ribs arranged on the suction box agaurt the wire while the vacuum is present in the vacuum chamber, arranging the ribs in a caved arrangement to guide the wire in a curve over the ribs while the vacuum is present in the vacuum chamber to increase the tension of the wire and to reduce a normal force produced by the vacuum and which is effective between the we and the ribs, and displacing the suction box toward or away from the wire to provide desired inlet and outlet angles of the wire in relation to the suction box.

* * * * *